United States Patent [19]

Uetani

[11] Patent Number: 4,603,387

[45] Date of Patent: Jul. 29, 1986

[54] APPARATUS FOR PREDICTING LOAD IN CAR OR ELEVATOR

[75] Inventor: Kenichi Uetani, Nishi Kasugai, Japan

[73] Assignee: Mitsubishi Denki Kabushiki Kaisha, Tokyo, Japan

[21] Appl. No.: 524,035

[22] Filed: Aug. 17, 1983

[30] Foreign Application Priority Data

Aug. 30, 1982 [JP] Japan ..... 57-150315

[51] Int. Cl.[4] ..... B66B 1/18

[52] U.S. Cl. ..... 364/424; 187/29 R

[58] Field of Search ..... 187/29 R; 364/554, 424

[56] References Cited

U.S. PATENT DOCUMENTS 4,043,429 8/1977 Hirasawa et al. ..... 187/29 R
4,044,860 8/1977 Kaneko et al. ..... 187/29 R
4,058,187 11/1977 Jacoby et al. ..... 187/29 R
4,081,059 3/1978 Kuzunuki et al. ..... 187/29 R
4,244,450 1/1981 Umeda et al. ..... 187/29 R
4,411,338 10/1983 Kuzunuki et al. ..... 187/29 R
4,458,787 7/1984 Uetani ..... 187/29 R

*Primary Examiner*—Parshotam S. Lall
*Attorney, Agent, or Firm*—Wenderoth, Lind & Ponack

[57] ABSTRACT

An apparatus for predicting a load in a car of an elevator, includes a first circuit for determining each floor getting-off proportion which indicates the ratio of the number of passengers getting off the car at each floor to the total number of passengers at that time, a second circuit for determining the number of in-car passengers to be increased in compliance with a hall call scheduled to be responded to, and a third circuit for decreasing the incremental number of passengers determined by the second circuit in accordance with the each floor getting-off proportion determined by the first circuit and for outputting the predicted in-car load calculated using the decreased number of passengers, whereby the predicted in-car load can be calculated with a small amount of data and within a short period of time.

9 Claims, 15 Drawing Figures

10

| DEST (%) | 1 | 2 | 3 | 4 | 5 | 6 | 7 | 8 |
|---|---|---|---|---|---|---|---|---|
| 8 | 15% | 30% | 30% | 35% | 40% | 50% | 100% | |
| 7 | 15% | 20% | 20% | 30% | 40% | 50% | | |
| 6 | 5% | 10% | 10% | 15% | 20% | | | |
| 5 | 25% | 25% | 30% | 20% | | | | |
| 4 | 10% | 10% | 10% | | | | | |
| 3 | 20% | 5% | | | | | | |
| 2 | 10% | | | | | | | |
| 1 | | | | | | | | |

BOARDING FL →

11

| PASS DIST NUM | 1 | 2 | 3 | 4 | 5 | 6 | 7 | 8 |
|---|---|---|---|---|---|---|---|---|
| 8 | 0 | 0 | 0 | 1.05 | 0 | 1 | 0 | |
| 7 | 0 | 0 | 0 | 0.9 | 0 | 1 | | |
| 6 | 0 | 0 | 0 | 0.45 | 0 | | | |
| 5 | 0 | 0 | 0 | 0.6 | | | | |
| 4 | 0 | 0 | 0 | | | | | |
| 3 | 0 | 0 | | | | | | |
| 2 | 0 | | | | | | | |
| 1 | | | | | | | | |

BOARDING FL →

(a)

TAUn

| FL | TAUn |
|---|---|
| 8 | 1 |
| 7 | 0.5 |
| 6 | 0.3 |
| 5 | 0.1 |
| 4 | 0.2 |
| 3 | 0.8 |
| 2 | 0.2 |
| 1 | 0 |

(b)

TADn

| FL | TADn |
|---|---|
| 8 | 0 |
| 7 | 0.1 |
| 6 | 0.1 |
| 5 | 0.2 |
| 4 | 0.1 |
| 3 | 0.9 |
| 2 | 0.5 |
| 1 | 1 |

(a)

TBUn

| FL | TBUn |
|---|---|
| 8 | 0 |
| 7 | 1 |
| 6 | 1 |
| 5 | 1 |
| 4 | 1 |
| 3 | 6 |
| 2 | 1 |
| 1 | 1 |

(b)

TBDn

| FL | TBDn |
|---|---|
| 8 | 2 |
| 7 | 2 |
| 6 | 2 |
| 5 | 3 |
| 4 | 2 |
| 3 | 4 |
| 2 | 1 |
| 1 | 0 |

APPARATUS FOR PREDICTING LOAD IN CAR OR ELEVATOR

BACKGROUND OF THE INVENTION

This invention relates to improvements in an apparatus for predicting a load in the car of an elevator.

In a group-supervisory elevator system, when a hall call has been registered, a car most suited to respond to the hall call is selected on the basis of information required for the group supervision, and the hall call is assigned to this car. In assigning the hall call, it is necessary to consider that the car will not pass any floor due to the full capacity of passengers. To this end, how a load in the car changes must be predicted during the operation of the elevator system.

There has been proposed a measure wherein the calculation of the predicted load in the car is performed in accordance with the destination floor percentages of waiting passengers. The percentages of the waiting passengers of respective halls and in respective directions are evaluated for frontward floors (i.e. floors located frontwards in the running direction of the car with respect to the particular floor where the car lies) in advance, and the predicted number of passengers get on the car by hall calls on the respective halls and in the respective directions and are distributed in accordance with the destination percentages concerning the frontward floors; the predicted number of passengers are subtracted in conformity with the distribution proportions at the frontward floors, whereby the predicted loads in the car at the respective floors are calculated. This will be described with reference to FIGS. 1 to 3 used for explaining the prior-art system for predicting the load in the car of an elevator.

In FIG. 1, numerals 1 to 8 indicate first to eighth floors, respectively. Symbols 4*a* and 6*a* denote the up calls of the fourth and sixth floors assigned to a car 9, respectively, while symbol 7*b* denotes the down call of the seventh floor. FIG. 2 shows a table 10 of destination floor percentages (for up scanning), and FIG. 3 a table 11 of destination distribution (for up scanning).

It is now assumed that the car 9 be ascending at the second floor 2 and respond to the up calls 4*a*, 6*a* of the fourth and six floors. The number of people who get on the car at the fourth floor 4 [or an in-car load factor (the percentages of getting-on passengers with respect to the capacity of the car)] is predicted from past data to be equal to three. Then, the number of persons in the car 9 is predicted to be three at the fourth floor 4. Next, the three people at the fourth floor are distributed to the frontward floors by multiplying the number of people by the percentages of the column of the getting-on floor 4 in the destination floor percentage table 10, the percentages being based on data outputted from a statistics unit (not shown). The results become as indicated in the column of the getting-on floor 4 in the destination distribution table 11. Likewise, when the number of people who get on the car at the sixth floor 6 is predicted to be two, the distributed numbers of people become as indicated in the column of the getting-on floor 6 in the destination distribution table 11. The calculated results are stored in a predetermined memory. At the fifth floor, $3-0.6=2.4$ (persons) remain in the car. $(2.4-0.45)+2=3.95$ (persons) remain at the sixth floor 6 because two persons get in here. The number of persons in the car is similarly predictively calculated to be $(3.95-0.9)-1=2.05$ (persons) at the seventh floor 7, and $(2.05-1.05)-1=0$ at the eighth floor 8.

With the above prediction apparatus, however, the data of the frontward floor destination percentages are required for the respective floors and for the respective directions, and the predictive loads need to be calculated on all the frontward floors for the respective floors and the respective directions, so that the period of time for the calculations inevitably becomes long. More specifically, although only the destination percentages of the eight floors in the up direction are listed in FIG. 2, actually the destination percentages thereof in the down direction are also necessary. When the apparatus is applied to a many-storied building having a still larger number of floors, more destination percentages are required accordingly. Therefore, a memory of large capacity is required. On the other hand, in predictively calculating the loads in the car, all the distributed numbers of people are computed for the respective floors as indicated in FIG. 3. That is, the predictive calculations are possible for the first time after the results (values 0, 0.6, 0.45, . . . etc. listed in FIG. 3) have been obtained. Therefore, the calculating period of time becomes long. In consequence, the determinations of the cars are made while calls having developed during the calculating operation are neglected, and a car assignment conforming to the real situation might not be performed.

SUMMARY OF THE INVENTION

This invention obviates the drawbacks described above, and has for its object to provide an apparatus for predicting a load in the car of an elevator in which the number of in-car passengers which increase in compliance with hall calls not having been responded to is decreased in accordance with each floor getting-off percentage, whereby the in-car load can be predictively calculated with a small amount of data and in a short period of time.

In order to accomplish the above-noted object, this invention comprises a first means for determining each floor getting-off proportion which indicates the ratio of the number of passengers which get off a car at each floor to the total number of passengers at that time, a seond means for determining the number of in-car passengers to increase in compliance with a hall call scheduled to be responded to, and a third means for decreasing the incremental number of passengers determined by the second means in accordance with the each floor getting-off proportion determined by the first means and for providing as its output a predicted in-car load calculated using the decreased number of passengers.

DESCRIPTION OF THE PREFERRED EMBODIMENTS

Referring now to FIGS. 4 to 13, an embodiment of this invention will be described. Suffixes A–C given to symbols indicate correspondences to elevators Nos. 1–3, respectively.

Figures 1, 2, 3:
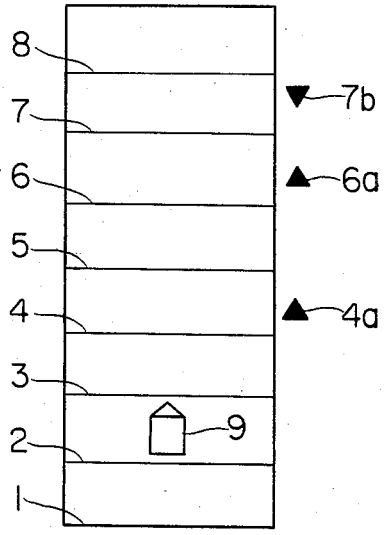
FIG. 1 is a diagram of the relationship between a car and hall calls.
FIG. 2 is a diagram of destination floor percentages (for up scanning)
FIG. 3 is a diagram of destination distribution (for up scanning)
Figures 4, 5, 6:
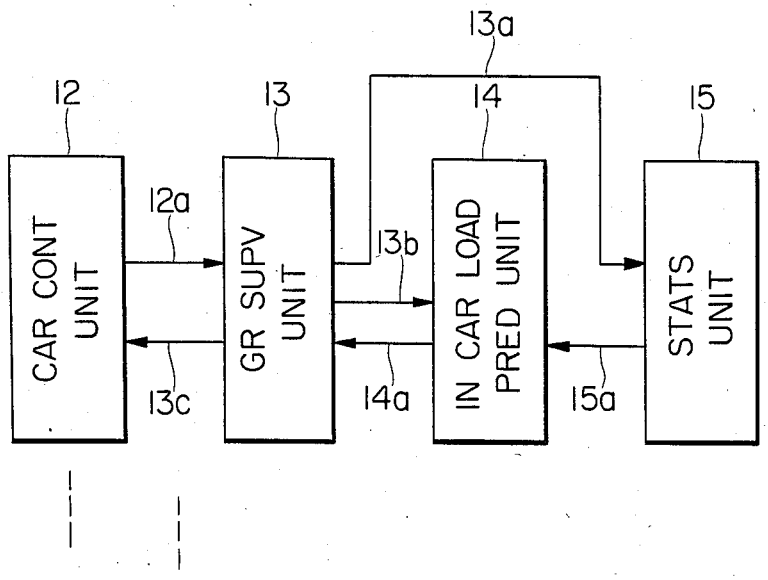
FIG. 4 is a block diagram of a group-supervisory circuit arrangement showing an embodiment of an apparatus for predicting a load in the car of an elevator according to this invention.
FIGS. 5(*a*) and 5(*b*) are diagrams of getting-off proportions showing the outputs of a statistics unit in FIG. 4.
FIGS. 6(*a*) and 6(*b*) are diagrams of the numbers of people, to-get-on-the-car corresponding to FIGS. 5(*a*) and 5(*b*), respectively.
Figure 7:
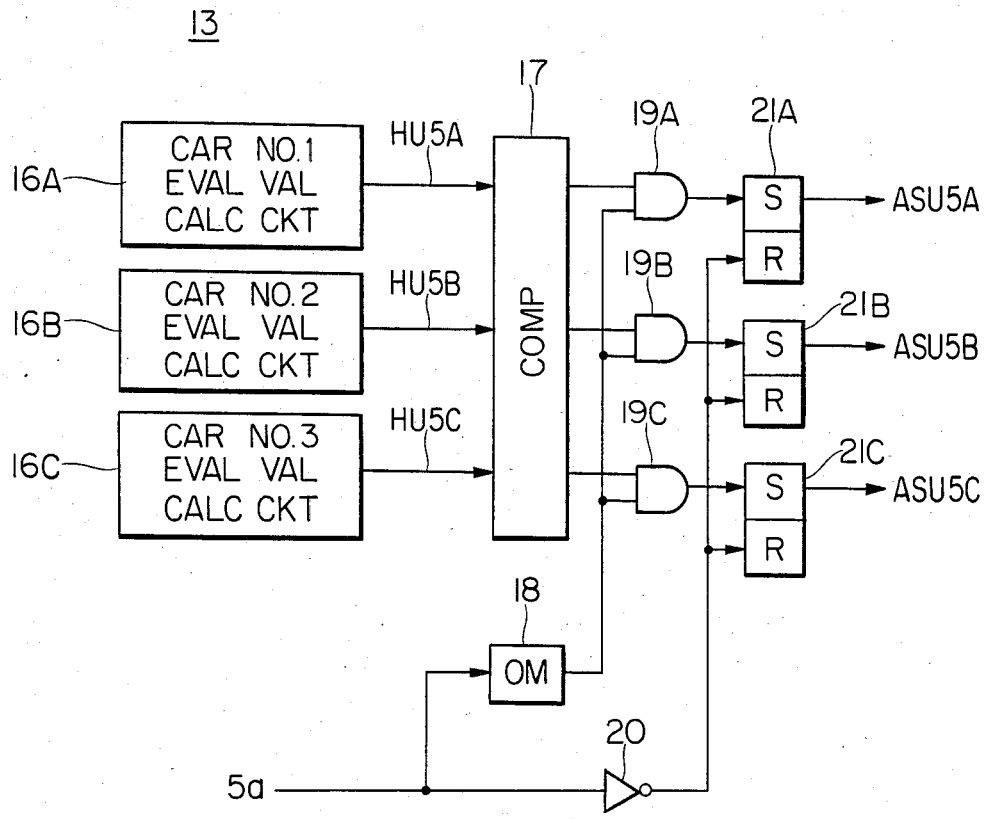
FIG. 7 is a block circuit diagram of a group-supervisory unit in FIG. 4.
Figure 8:
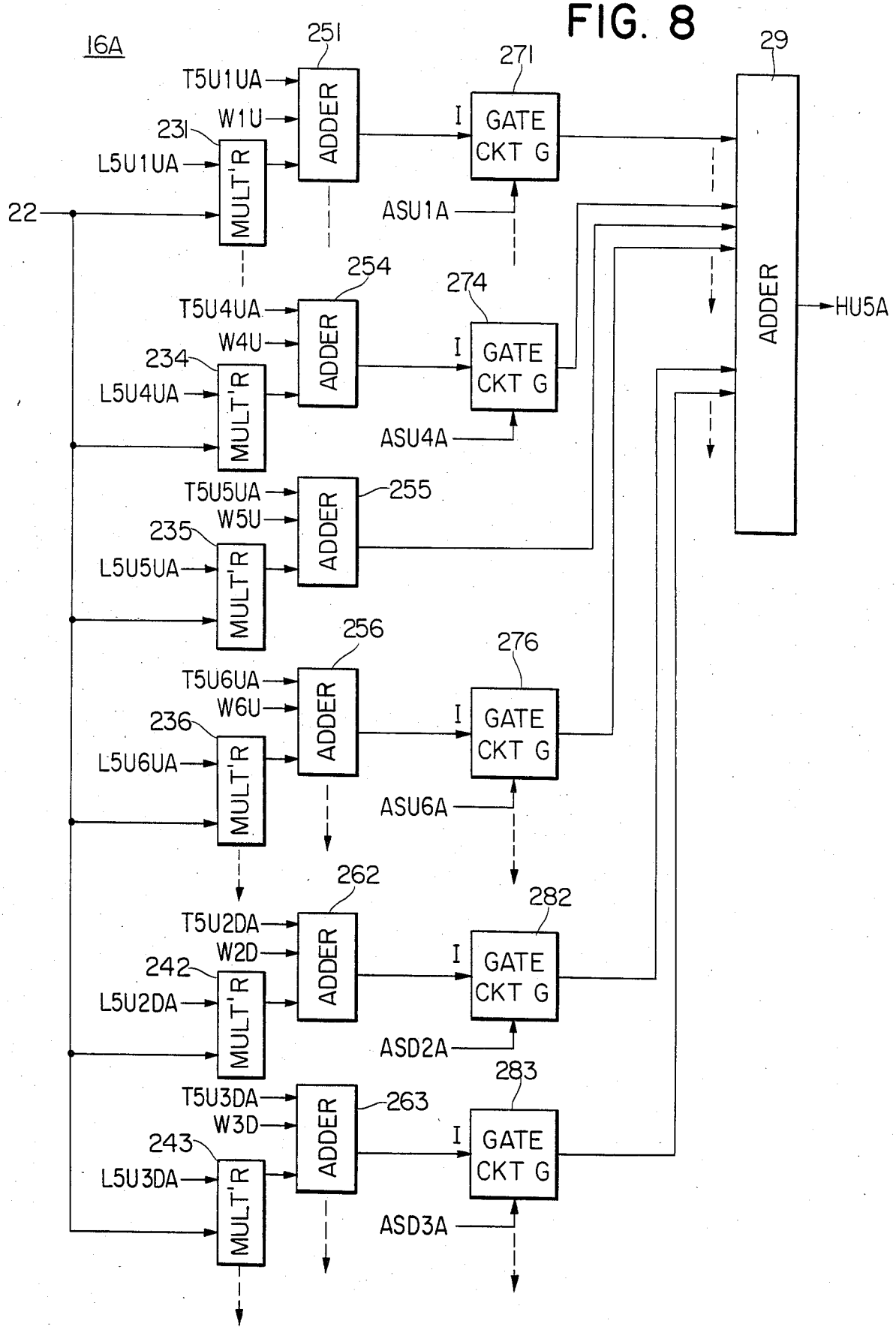
FIG. 8 is a block circuit diagram of a fifth-floor up-call tentative-assignment evaluation value calculating circuit for elevator No. 1 in FIG. 7.
Figure 9:
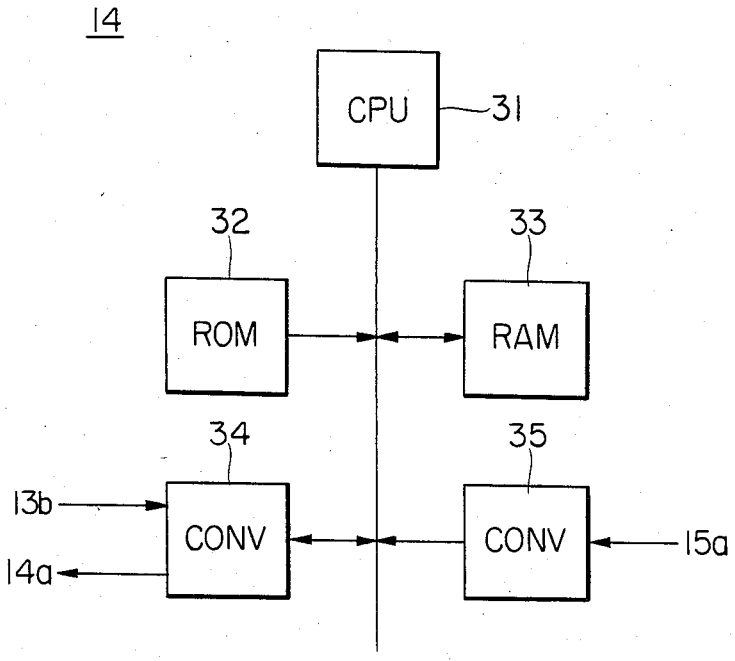
FIG. 9 is a block circuit diagram of an in-car load prediction unit in FIG. 4.
Figure 11:
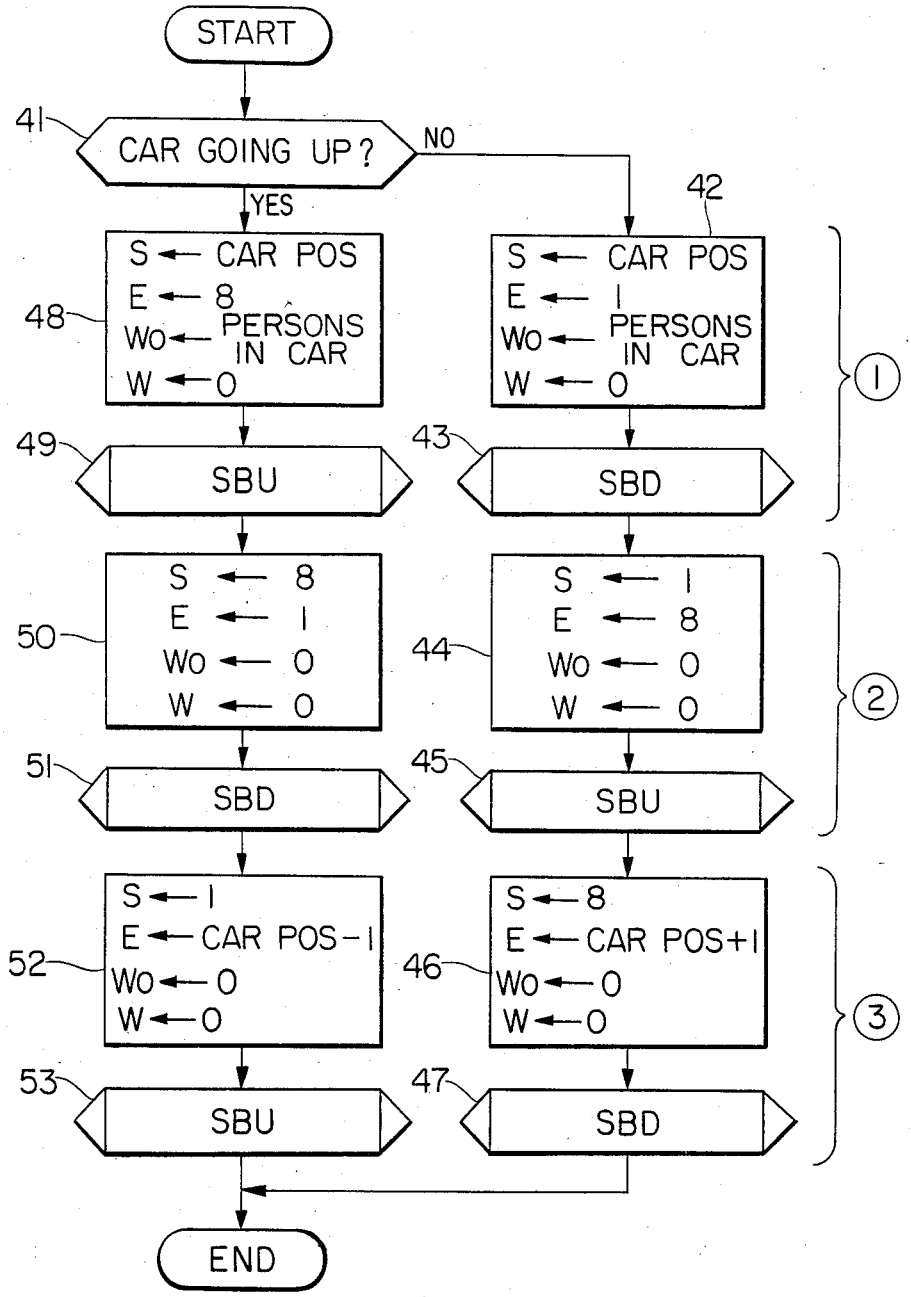
FIG. 11 is a flow diagram of the operations in FIG. 9.
Figure 12:
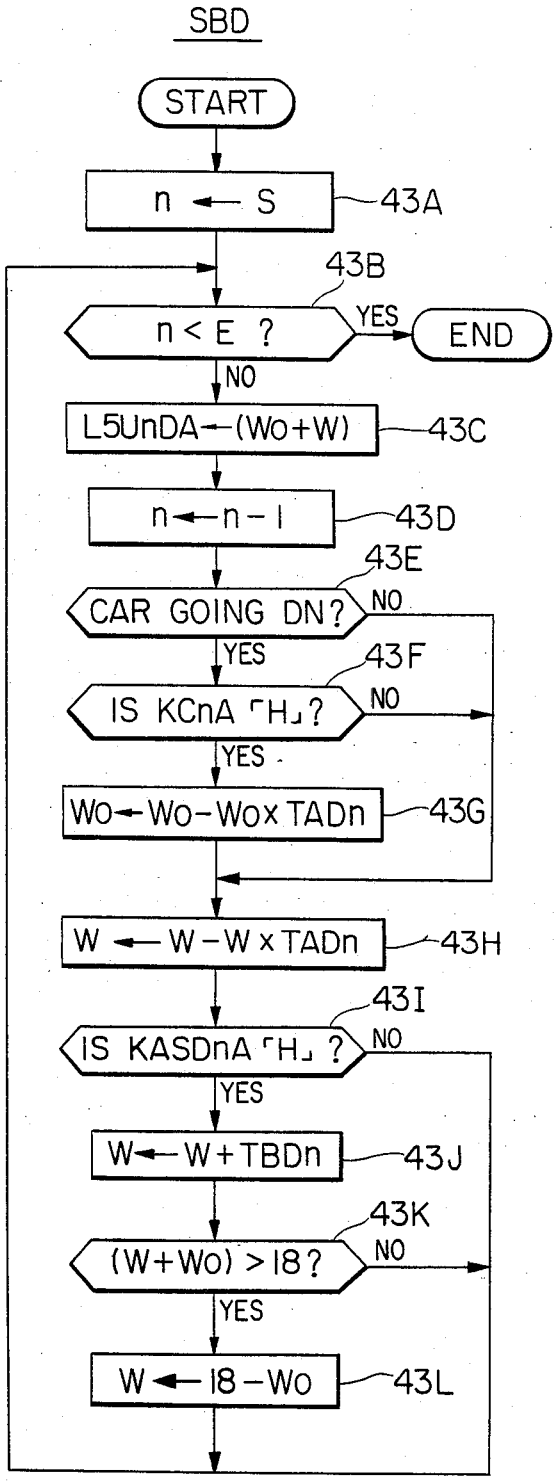
FIGS. 12 and 13 are flow diagram of the operations of steps SBD and SBU in FIG. 11, respectively.
Figure 13:
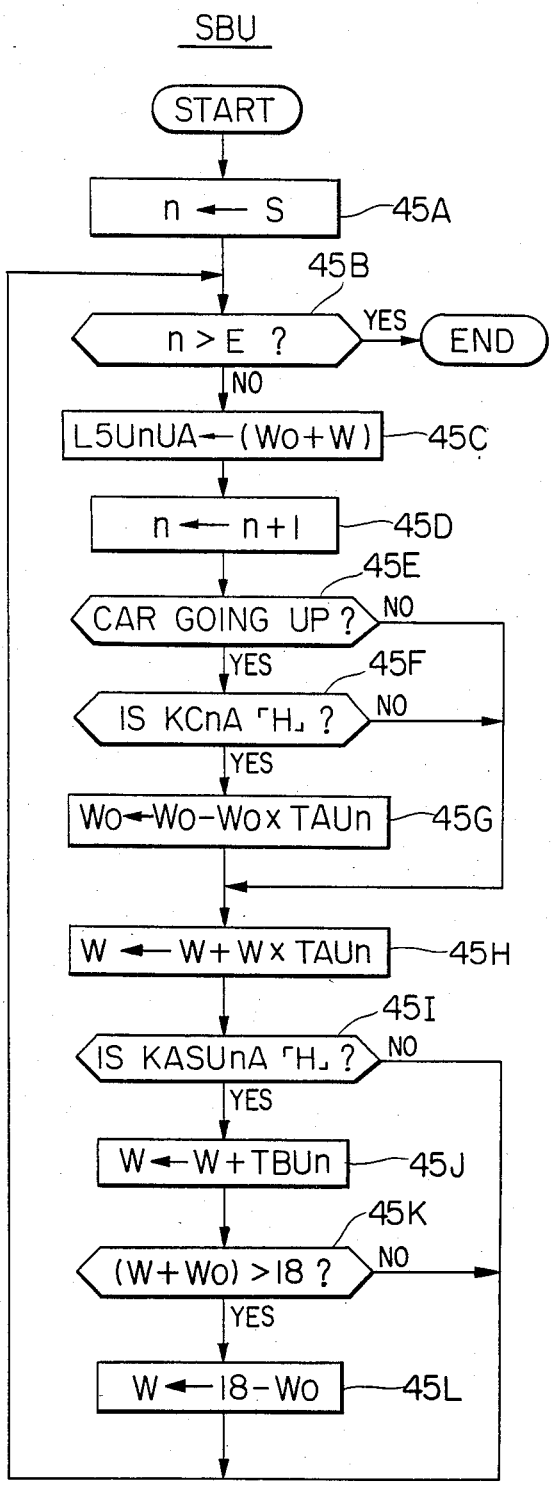

In FIG. 4, numeral 12 designates a car control unit (only one unit is shown in the figure) which is disposed for each car and which controls the corresponding car; symbol (12*a*) designates the outputs of the car control unit 12 which include car status signals indicating, e.g., a car call, an in-car load, a car running direction, etc. Numeral 13 designates a group-supervisory unit; symbol 13*a* designates the outputs of the group-supervisory unit 13 include which data signals required for taking statistics, such as a hall call, assigned call and car status; symbol 13*b* designates the outputs of the unit 13, which include car status signals such as an assigned call and car status; and 13*c* designates group supervision data such as an assigned call. Numeral 14 designates an in-car load prediction unit; symbol 14*a* designates a predictive in-car load signal. Numeral 15 designates a statistics unit to be described later; symbol 15*a* designates statistic data signals which correspond to an up-scanning getting-off proportion table TAUn (where n denotes floors hereinafter) as well as a down-scanning getting-off proportion table TADn illustrated in FIGS. 5(*a*) and 5(*b*), and an up-scanning getting-on person number table TBUn as well as a down-scanning getting-off person number table TBDn illustrated in FIGS. 6(*a*) and 6(*b*). In FIG. 7, symbol 5*a* designates a signal which becomes "H" (high level) when the up call of the fifth floor has been registered. Symbols 16A–16C designate fifth-floor up-call tentative-assignment evaluation value calculating circuits for elevators Nos. 1–3, respectively, and whose respective output evaluation value signals are HU5A–HU5C. Numeral 17 indicates a comparator whose output which corresponds to the minimum one of its inputs, becomes "H". Shown at numeral 18 is a monostable element OM whose output becomes "H" for a predetermined period of time when its input has become "H". The group-supervisory unit 13 in FIG. 7 further includes AND gates 19A–19C, a NOT gate (i.e.—an inverter) 20, and R/S flip-flops 21A–21C (hereinbelow, termed "memories"). Symbols ASU5A–ASU5C denote the outputs of the memories 21A–21C, which are assignment signals that become "H" when the elevators Nos. 1–3 have been assigned to the up call of the fifth floor, respectively. In FIG. 8, numeral 22 designates a signal which represents a fixed value (the coefficient of conversion for putting a load value into an evaluation value). Symbols L5U1UA–L5U7UA (some of which are not shown) denote signals which represent predicted in-car loads at the responses of the elevator No. 1 to the up calls of the halls of the first–seventh floors under the assumption that the elevator No. 1 has been assigned to the up call of the fifth floor, respectively. Similarly, symbols L5U2DA–L5U8DA (some of which are not shown) denote predicted in-car load signals at the responses to the down calls of the halls of the second–eighth floors, respectively. Numerals 231–237 and 242–248 (some of which are not shown) designate multipliers each of which multiplies its two inputs. Symbols T5U1UA–T5U7UA (some of which are not shown) denote signals representative of times in which the elevator No. 1 is anticipated to arrive at the up calls of the first–seventh floors under the assumption that the elevator No. 1 has been assigned to the up call of the fifth floor, respectively. Similarly, symbols T5U2DA–T5U8DA (some of which are not shown) denote arrival anticipation time signals for the down calls of the second–eighth floors, respectively. Symbols W1U–W7U (some of which are not shown) denote signals which represent the present waiting times of the up calls of the first–seventh floors (which are zero when no call has been registered), respectively. Similarly, symbols W2D–W8D (some of which are not shown) denote waiting time signals for the down calls of the second–eighth floors, respectively. Numerals 251–257 and 262–268 (some of which are not shown) designate adders each of which adds its three inputs. Symbols ASU1A–ASU7A (some of which are not shown) denote assignment signals which become "H" when the elevator No. 1 has been assigned to the up calls of the first–seventh floors, respectively. Similarly, symbols ASD2A–ASD8A (some of which are not shown) denote assignment signals for the down calls of the second–eighth floors, respectively. Numerals 271–274, 276, 277 and 282–288 (some of which are not shown) designate gate circuits each of which delivers its input I when its input G has become "H". Shown at numeral 29 is an adder which adds all its inputs. In FIG. 9, numeral 31 designates the central processing unit of a microcomputer (hereinbelow, termed "CPU"). Numeral 32 indicates a read only memory (hereinbelow, termed "ROM") in which programs and fixed value data in FIGS. 11–13 are written, while numeral 33 denotes a random access memory (hereinbelow, termed "RAM") which stores data in storage addresses. A converter 34 converts the car status signals 13*b* into the information of the electronic computer, and converts the calculated results of the electronic computer into the predictive in-car load signals 14*a*. A converter 35 converts the statistic data signals 15*a* into the information of the electronic computer.

Figure 10:
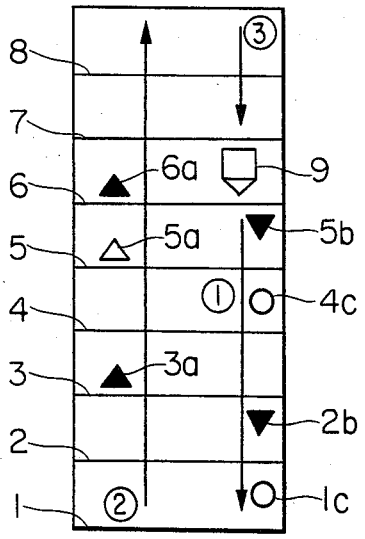
FIG. 10 is a diagram of the relationship between the car and calls for explaining operations in FIG. 9.

In FIG. 10, symbols 3*a* and 6*a* denote the up calls of the third and sixth floors assigned to the car 9 of the elevator No. 1, symbol 5*a* denotes the up call of the fifth floor (not assigned yet), symbols 2*b* and 5*b* denotes the assigned down calls of the second and fifth floors, and symbols 1*c* and 4*c* denotes the car calls of the first and fourth floors to the car 9, respectively. In FIG. 11, numerals 41–53 indicate operating steps based on a program for predictively calculating a load in the car 9, under the assumption that the up call 5*a* of the fifth floor has been assigned to the elevator No. 1 (hereinbelow, termed "tentative assignment"). In FIG. 12, symbols 43A–43L indicate the substeps corresponding to each of the identical steps 43, 47 and 51. In FIG. 13, symbols 45A–45L indicate the substeps corresponding to each of the identical steps 45, 49 and 53.

Now, the operations of this embodiment will be described.

First, the operations will be outlined with reference to FIG. 4.

When the car status signals 12*a* have been produced from the car control unit 12, the group-supervisory unit 13 tentatively assigns the car to hall calls, so as to send the car status signals 13*b* to the in-car load prediction unit 14 and to deliver the required statistics data 13*a* to the statistics unit 15. The statistics unit 15 has been well known from, e.g., U.S. Pat. No. 4,411,238 to Kuzunuki et al. It stores for each floor and in each direction the proportion (getting-off proportion) of passengers (load) who have gotten off the car in response to the car call, to passengers who are riding the car to the car call floors, on the basis of the required statistics data signals 13*a* for certain past days, and it stores them as the up-scanning getting-off proportion table TAUn and down-scanning getting-off proportion table TADn respectively shown in FIGS. 5(*a*) and 5(*b*). Likewise, it stores for each floor and in each direction the number of people who have gotten on the car in response to the hall call and the number of hall calls, finds the number of people to get on the car/the numbers of hall calls and stores the number of people as the up-scanning getting-on person number table TBUn and down-scanning getting-on person number table TBDn respectively shown in FIGS. 6(*a*) and 6(*b*). These are sent to the in-car load prediction unit 14 as the statistic data signals 15*a*. The prediction unit 14 calculates the predictive in-car loads from the inputs 13*b* and 15*a*, and supplies the outputs 14*a* to the group-supervisory unit 13. Thus, the group-supervisory unit 13 generates the group supervision data 13*c*, to realize an operation of good service which does not incur the passage of the car due to its full capacity of passengers.

Let it now be supposed that, as indicated in FIG. 10, the car 9 is descending at the sixth floor 6, while it has been assigned to the up call 3*a* of the third floor, the up call 6*a* of the sixth floor, the down call 5*b* of the fifth floor and the down call 2*b* of the second floor and is awaiting the car calls 1*c* and 4*c* of the first and fourth floors. Here, it is assumed that the up call 5*a* have been registered at the fifth floor.

This information is loaded into the in-car load prediction unit 14 through the converter 34 as the car status signals 13*b*. On the other hand, the statistic data signals 15*a* from the statistics unit 15 are loaded through the converter 35. Then, the CPU 31 operates in accordance with the program stored in the ROM 32 and exchanges signals with the RAM 33, to start the scanning calculations indicated in FIGS. 11–13.

First, in the step 41, the direction of the car 9 is decided. Since the car 9 is descending, the operating flow proceeds to the step 42, in which a scanning start floor S is set at a car position floor (the sixth floor at first), a scanning end floor E is set at the first floor, an initial in-car load (number of persons) $W_O$ is set at the present number of persons in the car 9, and an incremental in-car load W based on a hall call not having been responded to is set at zero. Next, the operating flow proceeds to the step 43 comprising steps 43A–43L, in the step 43A of which the floor n is set at the scanning start floor S as shown in FIG. 12. In the step 43B, whether or not the floor n is smaller than the scanning end floor E is decided. Unless $n<E$, the operating flow proceeds to the step 43C, in which the initial in-car load $W_O$ till then and the incremental in-car load W are added into the n-th floor down hall predicted in-car load L5UnDA. In the step 43D, $(n-1)$ is set to update the scanning floor n. The direction of the car 9 is decided in the step 43E, and the presence of a car call signal KCnA is decided in the step 43F. In the absence of the car call at the scanning floor n, the operating flow proceeds to the step 43H, and in the presence of the same, the operating flow proceeds to the step 43G, in which $W_O-W_O\times TADn$ is calculated, namely, the initial in-car load $W_O$ is decreased in accordance with the down-scanning getting-off proportion table TADn. Subsequently, in the step 43H, $W-W\times TADn$ is calculated, namely, the incremental in-car load W based on the hall call not having been responded to is decreased in accordance with the down-scanning getting-off proportion table TADn. In the step 43I, the presence of assigned or tentatively-assigned down call signals KASDnA (the down calls 5*b* and 2*b* of the fifth floor and second floor) is decided. Down to the first floor 1, there are the down calls 2*b* and 5*b* already assigned, but there is no down call tentatively assigned. Therefore, the operating flow returns to the step 43B, and the same steps are repeated. When the scanning has been performed down to the first floor 1 to establish $n<1$ in the step 43B, this program ends. These steps form the scanning procedure 1 . A concrete calculation of the step 43C in the above scanning will be exemplified.

Assuming that the load of the car 9 be five persons in the initial condition, $W_O=5$ and $W=0$, and hence, $L5U6DA\leftarrow W_O+W=5+0=5$. At $n=5$, $W\leftarrow W+TBD5$ (FIG. 6(*b*))$=0+3=3$ has already been calculated in the step 43J, so that $L5U5DA\leftarrow W_O+W=5+3=8$. In addition, at $n=4$, $W_O\leftarrow W_O-W_O\times TAD4$ (FIG. 5(*b*))$=5-5\times0.1=4.5$ has already been calculated in the step 43G, and $W\leftarrow W-W\times TAD4=3-3\times0.1=2.7$ has been calculated in the step 43H, so that $L5U4DA\leftarrow W_O+W=4.5+2.7=7.2$.

Subsequently, the operating flow proceeds to the step 44, in which the scanning start floor S is set at the first floor, the scanning end floor E is set at the eighth floor, the initial in-car load $W_O$ is set at zero (all the passengers get off the car down to the first floor 1 inclusive), and the incremental in-car load W based on the hall call not having been responded to is set at zero. Next, the operating flow proceeds to the step 45, in which the steps 45A–45E are carried out in the same manner as in the down scanning. Since, in this case, the car 9 is in the down direction, the operating flow jumps to the step 45H, in which the decrease of the in-car load W based on the hall call not having been responded to is carried out. In the step 45I, the presence of assigned or tentatively-assigned up call signals KASUnA (the up calls 3*a* and 6*a* of the third and sixth floors and unassigned fifth floor up call 5*a*) is decided. Besides the already-assigned up calls 3*a* and 6*a*, there is the tentatively-assigned up call 5*a* at the fifth floor 5, the operating flow proceeds to the step 45J, in which $W+TBUn$ is calculated, namely, the getting-on load based on the hall call not having been responded to is added in accordance with the up-scanning getting-on person number table TBUn. Unless, in the step 45K, the load in the car 9 is greater than the carrying capacity (assumed to be 18 persons here), the operating flow returns to the step 45B, and if the converse is true, the in-car load W is set at $18-W_O$ in the step 45L. Thus, when $n>8$ in the step 45B, this program ends. These steps form the scanning procedure 2 .

Subsequently, the operating flow proceeds to the step 46, in which the scanning start floor S is set at the eighth floor, the scanning end floor E is set at the floor on this side of the car position floor by one floor (6+1=7 (-th floor)), the initial in-car load $W_O$ is set at zero, and the incremental in-car load W based on the hall call not having been responded to is set at zero. Next, the operating flow proceeds to the step 47, in which the down scanning is performed as stated above. When n<7 in the step 43B, this program ends. These steps form the scanning procedure 3 .

When the car 9 is in the up direction, the operating flow proceeds from the step 41 to the steps 48–53. Since these steps can be readily understood from the foregoing, they shall be omitted from the description.

The predictive in-car load signals L5U1UA–L5U7UA and L5U2DA–L5U8DA of the elevator No. 1 thus calculated are outputted through the converter 34. These signals are multiplied by the fixed value 22 by means of the multipliers 231–237 and 242–248. On the other hand, the group-supervisory unit 13 calculates by the use of well-known circuitry the signals T5U1UA–T5U7UA and T5U2DA–T5U8DA of arrival anticipation times in which the elevator No. 1 is anticipated to arrive at the up calls of the first–seventh floors and the down calls of the second–eighth floors, and the signals W1U–W7U and W2D–W8D of the waiting times of the up calls of the first–seventh floors and the down calls of the second–eighth floors. These corresponding signals are respectively added by the adders 251–257 and 262–268. The output of the adder 255 is supplied to the adder 29. Since the gate circuits 273, 276, 285 and 282 are enabled by the respective assignment signals ASU3A, ASU6A, ASD5A and ASD2A, the outputs of the adders 253, 256, 265 and 262 are also supplied to the adder 29. The added value of these inputs becomes the evaluation value signal HU5A. Likewise, the calculations are performed as to the elevators Nos. 2 and 3, and the respective evaluation value signals HU5B and HU5C are outputted. The comparator 17 selects the minimum one of the evaluation value signals HU5A–HU5C, and renders the corresponding output "H". It is now supposed that the minimum evaluation value signal corresponds to that of elevator No. 1. Meanwhile, when the up call registration signal 5*a* of the fifth floor has become "H", the output of the monostable element 18 becomes "H" for the predetermined period of time. Therefore, the output of the AND gate 19A becomes "H", the memory 21A is set, and the up call assignment signal ASU5A of the fifth floor for the elevator No. 1 becomes "H".

In this way, the in-car loads are properly predicted, they are combined into the evaluation value, and the evaluation value is allotted to the car. Therefore, the frequence of the passage of the car due to the full capacity of passengers etc. lowers, and a favorable service is attained.

When the car 9 has responded to the fifth floor, the up call signal 5*a* is released to become "L" (low level), and the output of the NOT gate 20 becomes "H", so that the memory 21A is reset to render the assignment signal ASU5A "L".

While the embodiment has been described on the assignment of the up call 5*a* of the fifth floor, the up calls and down calls of the other floors are quite similarly dealt with.

The procedure of decreasing the initial in-car load, which consists of the steps 43E–43G and the steps 45E–45G, and may conform to a getting-off proportion table (not shown) separately set or may well resort to the destination floor percentage table 10 in the prior art.

While the getting-off proportion tables TAUn and TADn have been explained as being obtained with the statistics unit 15, it is also allowed to set tables as shown in FIGS. 5(*a*) and 5(*b*) by the use of fixed values suited to a building and to employ the tables for the calculations.

As set forth above, according to this invention, the proportions of getting-off at respective floors are determined, incremental in-car passengers for hall calls not having been responded to are decreased in accordance with the floor getting-off proportions, and predicted in-car loads are calculated by the use of the decreased in-car passenger numbers. It is therefore possible to reduce calculating data and to shorten a calculating period of time.

What is claimed is:

1. An apparatus for predicting a load in a car of an elevator, comprising a first means for determining each floor getting-off proportion which corresponds to a ratio of a number of passengers getting off the car at each floor to a total number of passengers in the car at that time, a second means for determining an increase in a number of in-car passengers in compliance with a hall call scheduled to be responded to, and a third means for decreasing the incremental number of passengers determined by said second means in accordance with said floor getting-off proportion determined by said first means and for outputting the predicted in-car load calculated using the decreased number of passengers.

2. An apparatus for predicting a load in a car of an elevator as defined in claim 1, wherein said first means is supplied with past and present traffic conditions and calculates statistical data of said each floor getting-off proportion.

3. An apparatus for predicting a load in a car of an elevator as defined in claim 2, wherein said first means determines said each floor getting-off proportion for each running direction of the car and stores the getting-off proportion at the respective floors and in the respective directions.

4. An apparatus for predicting a load in a car of an elevator as defined in claim 1, wherein each floor getting-off proportion of said first means is predetermined.

5. An apparatus for predicting a load in a car of an elevator as defined in claim 1, wherein said second means stores a number of persons having gotten on the car during response of the car to the hall call and a number of hall calls at each floor and in each direction, and determines a value of getting-on person number/hall call number and stores the value as the getting-on person number at each floor and in each direction.

6. An apparatus for predicting a load in a car of an elevator as defined in claim 1, wherein said third means performs the calculations of the predicted in-car loads while successively scanning the respective floors in an order conforming to a running direction of the car, and decreases the incremental numbers of passengers at the respective scanning floors in accordance with the getting-off proportions of said scanning floors.

7. An apparatus for predicting a load in a car of an elevator as defined in claim 6, wherein when performing the scanning calculation as to the floor at which a car call has been registered, said third means decreases the present in-car load in accordance with the getting-off proportion of the particular scanned floor.

8. An apparatus for predicting a load in a car of an elevator as defined in claim 6, wherein when performing the scanning calculation as to the floor which has an assigned or tentatively-assigned hall call, said third means subtracts the incremental number of passengers in accordance with the getting-off proportion corresponding to the particular floor and thereafter adds the incremental number of passengers corresponding to said floor to the resultant value.

9. An apparatus for predicting a load in a car of an elevator as defined in claim 6, wherein said third means successively calculates the predicted in-car loads at the respective floors in conformity with the running direction of the car, from a scanning calculation start floor to an end floor in said running direction, and thereafter performs the calculations at the respective floors from said end floor to another end floor in a direction opposite to said running direction of the car, and subsequently performs the calculations from said other end floor to said scanning calculation start floor in conformity with said running direction of the car.

* * * * *